United States Patent [19]

Jseng

[11] Patent Number: 4,886,469

[45] Date of Patent: Dec. 12, 1989

[54] PLUG WITH ADJUSTABLE PINS

[76] Inventor: Liang-Chuan Jseng, No. 36, Lane 134, Tong-An Rd., Tainan, Taiwan

[21] Appl. No.: 268,384

[22] Filed: Nov. 7, 1988

[51] Int. Cl.[4] ..... H01R 13/15

[52] U.S. Cl. ..... 439/265; 439/269

[58] Field of Search ..... 439/253, 254, 259, 263, 439/265, 266, 268, 269, 270

[56] References Cited

U.S. PATENT DOCUMENTS 1,957,773 5/1934 Good ..... 439/269
2,099,986 11/1937 Muller ..... 439/269 X
2,476,365 7/1949 Greco ..... 439/265
2,476,510 7/1949 Rosner ..... 439/265

*Primary Examiner*—Neil Abrams
*Assistant Examiner*—Khiem Nguyen
*Attorney, Agent, or Firm*—Bacon & Thomas

[57] ABSTRACT

A plug with adjustable pins wherein the pins can be adjusted either inwardly or outwardly for enabling a tighter fit in the socket by means of an adjusting unit including a cylindrical knob and a pair of concentric end screws threadedly secured to corresponding ends of the pins.

2 Claims, 4 Drawing Sheets

PLUG WITH ADJUSTABLE PINS

BACKGROUND OF THE INVENTION

This invention relates to a plug for making connection with a supply of electric current, particularly to a plug with adjustable pins.

The known plug used for making a connection with a supply of electric current is generally comprised of two pins for fitting into an electric socket. It is found disadvantageous that the fitting of the pins are sometimes not tight enough, as, for example, the known plug is fitted in suspension or is accidentally struck, to prevent it from being withdrawn.

SUMMARY OF THE INVENTION

An object of this invention is to provide a plug with adjustable pins which can diminish the disadvantages of a known plug.

With the above object in view, this invention provides a plug with adjustable pins which obviates the inconvenience encountered hitherto, the structure of which comprises a casing of two mating halves having a pair of spaced slots in a front wall, a cave in a rear wall, a pair of opposite circular holes communicating the inside of the casing and the cave, located in wings of the rear wall, a pair of opposite recesses located in the inner surfaces of two opposed main walls of the casing close to the slots and two opposite openings properly formed in the main walls; a pair of pins installed inside the casing with their front portions protruded from the slots, both having opposite cylindrical trunnions extending vertically for fitting into the recesses of the casing and two inner-threaded holes transversely formed in the opposite ends; an adjusting unit having a cylindrical adjusting knob made of electric-insulating material and two concentric end screws with external threads respectively matching with the inner threads of the holes of the pins; and means for securing the halves in their aligned and mating position through the openings of the casing.

BRIEF DESCRIPTION OF THE DRAWINGS

The present invention exemplary embodiment will be described in detail with respect to the following drawings, wherein.

DETAILED DESCRIPTION OF THE PREFERRED EMBODIMENT

The following is a detailed description of the best presently contemplated embodiment of the invention. This description is not to be taken in a limiting sense, but is made merely for the purpose of illustrating the general principles of the invention.

Figure 1:
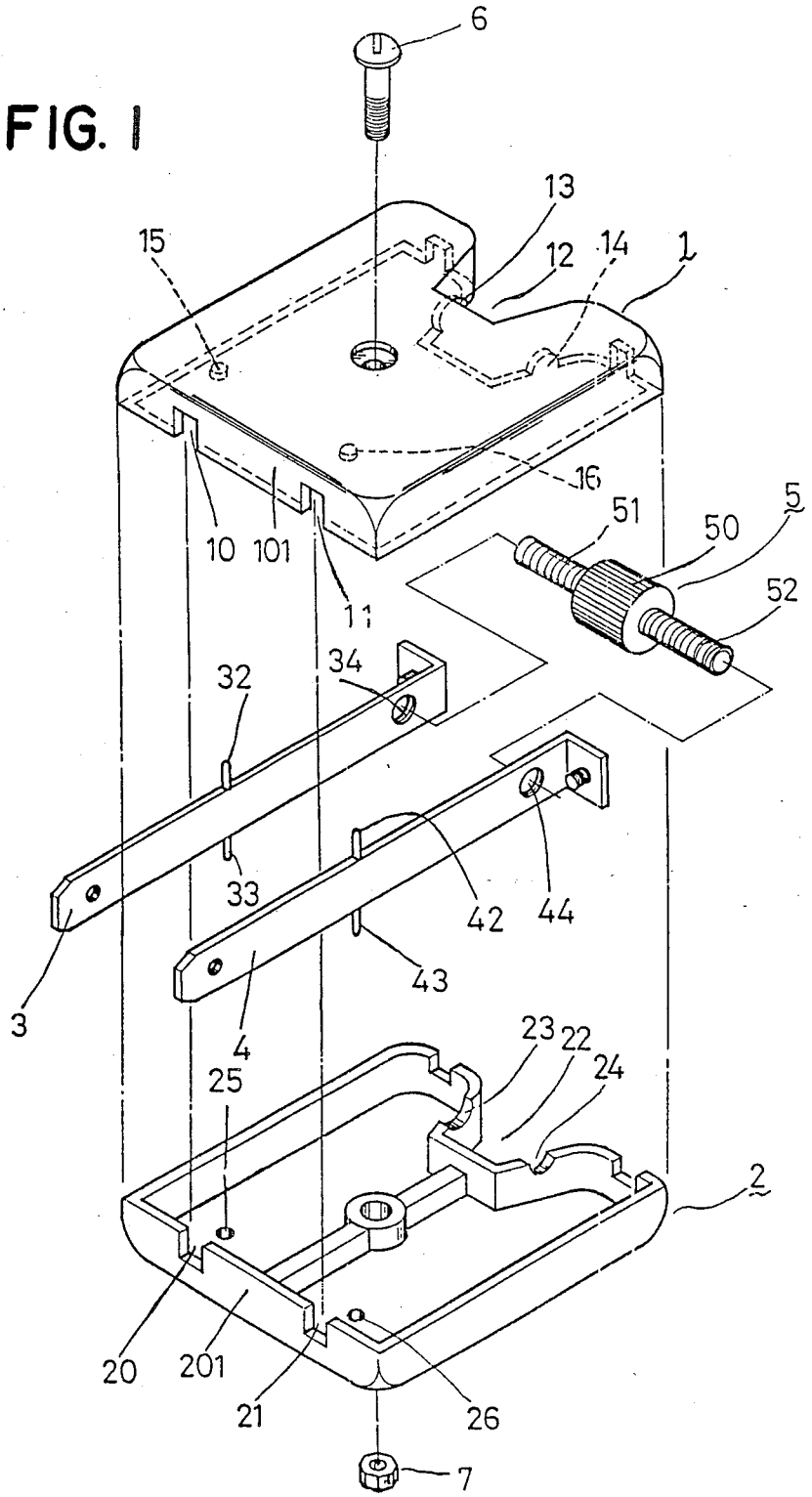
FIG. 1 is a perspective and explode view illustrating a preferred embodiment of the present invention.
Figure 2:
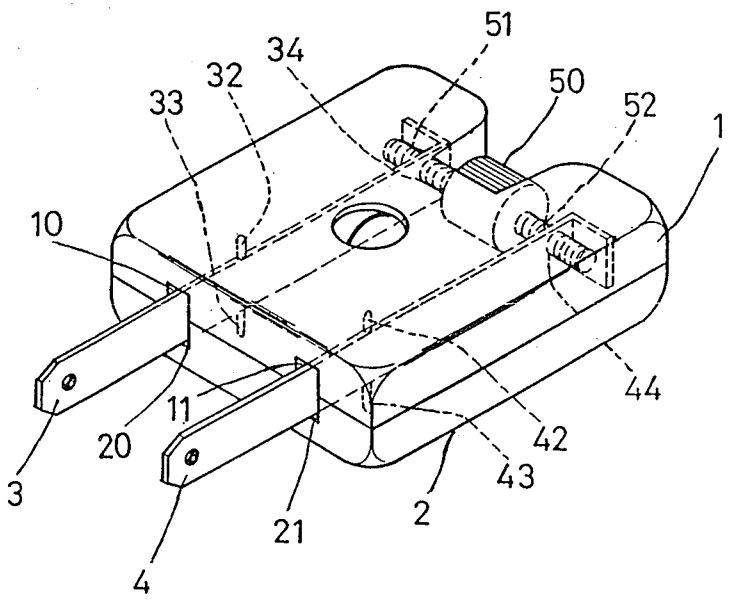
FIG. 2 is a perspective view of this invention in assembled condition.

Referring to FIGS. 1 and 2, a plug with adjustable pins according to the present invention comprises a casing consisting of two matching halves 1, 2 which can be secured in their aligned and mating position by a bolt 6 going through corresponding openings in the two opposite horizontal main walls of the two halves 1, 2 and firmly threaded with a nut 7 from the bottom, a pair of pins 3, 4 and an adjusting unit 5.

The construction of the contacting edges of the halves 1, 2 are substantially of symmetrical configuration. Each of the halves 1, 2 is comprised of a pair of spaced grooves 10, 11 or 20, 21 in a front wall 101 or 201, a cave 12 or 22 formed inwardly in the mid portion of a rear wall opposed to the front wall 101 or 201, a pair of opposite semi-circular grooves 13, 14 or 23, 24 located in the wings of the rear wall and a pair of spaced recesses 15, 16 or 25, 26 located in the inner surface of the main walls close to the respective grooves 10, 11 or 20, 21.

In the middle portions of the pins 3, 4, there are two pairs of opposite cylindrical trunnions 32, 33 and 42, 43 extending vertically for fitting into the recesses 15, 25 and 16, 26 so that the pins 3, 4 can rotate about their respective trunnions. Two inner threaded holes 34, 44 running transversely are formed in the straight ends of the pins 3, 4.

The adjusting unit 5 comprises a cylindrical adjusting knob 50 made of electric-insulating material and two concentric end screws 51, 52 with external threads respectively matching with the inner threads of the holes 34, 44 of the pins 3, 4. The threads of the end screws 51, 52 and the holes 34, 44 are so arranged that when the adjusting knob 50 is turned clockwise or counterclockwise, the rear ends of the pins 3, 4 will be simultaneously and synchronously moved either inward or outward.

In assembly, the pins 3, 4 are protruded from spaced slots, which are large enough to permit the swing motions of the front portions of the pins, formed with the grooves 10, 11, 20, 21 in the front walls of the halves, the cylindrical trunnions 32, 33, 42, 43 are fitted into the respective recesses 15, 16, 25, 26, and the end screws 51, 52 of the adjusting unit 5 are threaded through the holes 34, 44 of the pins 3, 4 and further retained in the circular holes formed with semi-circular grooves 13, 14, 23, 24 in the rear walls of the halves 1, 2 whilst the adjusting knob 50 is placed in the cave 12, 22 when the two halves 1, 2 of the casing is secured in their aligned and mating position by the bolt 6 and nut 7.

Figure 4:
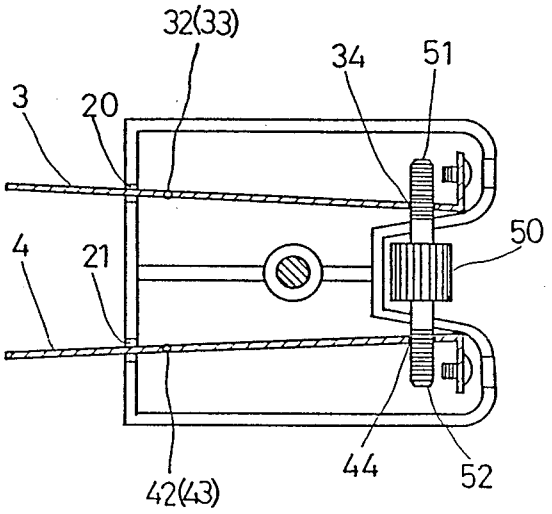
FIG. 4 is a cross-sectional view of this invention wherein the pins are outwardly adjusted.
Figure 3:
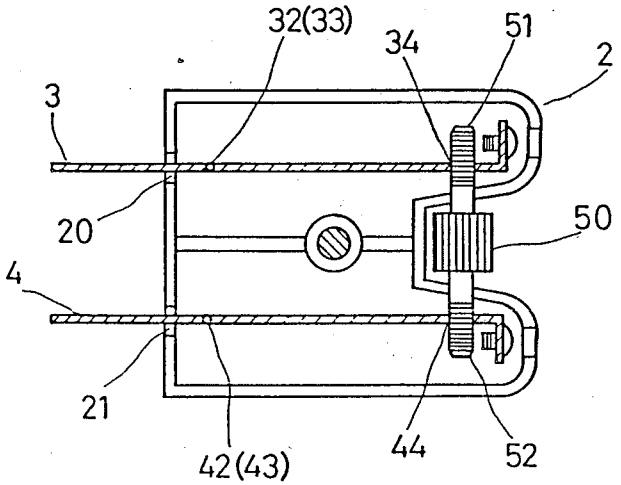
FIG. 3 is a cross-sectional view of this invention shown in FIG. 2 wherein the pins are placed in normal positions.
Figure 5:
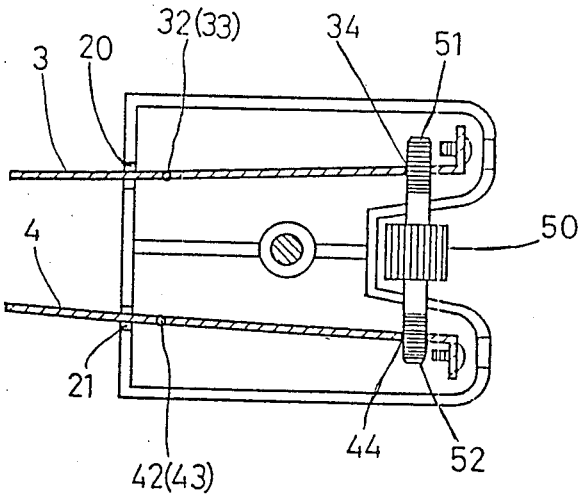
FIG. 5 is a cross-sectional view of this invention wherein the pins are inwardly adjusted.

In operation, as shown in FIGS. 3, 4 and 5, the adjusting knob 50 when turned either way will adjust the pins 3, 4 either inwardly or outwardly for enabling a tighter fit in the socket.

While the invention has been described with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims, which scope is to be accorded the broadest interpretation so as to encompass all such modifications and equivalent structure.

What is claimed is:

1. A plug with adjustable pins comprising;

a casing of two mating halves having a pair of spaced slots in a front wall, a cave in a rear wall, a pair of opposite circular holes communicating the inside of the casing and the cave, located in wings of the rear wall, a pair of opposite recesses located in the inner surfaces of two opposed main walls close to the slots and two opposite openings properly formed in the main walls;

a pair of pins installed inside the casing with front portions protruded from the slots, both having opposite cylindrical trunnions extending vertically for fitting into the recesses of the casing and two inner-threaded holes transversely formed in the opposite ends;

an adjusting unit having a cylindrical adjusting knob made of electric-insulating material and two concentric end screws with external threads respectively matching with the inner threads of the holes of the pins; and means for securing the halves of the casing in their aligned and mating position through the openings of the casing.

2. A plug with adjustable pins as claimed in claim 1 wherein the threads of the end screws are so arranged that when the adjusting knob is turned either way, the matched ends of the pins will be simultaneously moved either inward or outward.

* * * * *

UNITED STATES PATENT AND TRADEMARK OFFICE

CERTIFICATE OF CORRECTION

PATENT NO. : 4,886,469

DATED : December 12, 1989

INVENTOR(S) : Liang-Chuan Tseng

It is certified that error appears in the above-identified patent and that said Letters Patent is hereby corrected as shown below:

Title page:

The inventor's name is "LIANG-CHUAN TSENG".

Signed and Sealed this

Sixteenth Day of October, 1990

*Attest:*

HARRY F. MANBECK, JR.

*Attesting Officer*

*Commissioner of Patents and Trademarks*